US010204604B2

(12) United States Patent
Barkley et al.

(10) Patent No.: US 10,204,604 B2
(45) Date of Patent: Feb. 12, 2019

(54) BACHI FOR A SHAMISEN

(71) Applicants: John Barkley, Raleigh, NC (US); Alexander Wade, Raleigh, NC (US)

(72) Inventors: John Barkley, Raleigh, NC (US); Alexander Wade, Raleigh, NC (US)

( * ) Notice: Subject to any disclaimer, the term of this patent is extended or adjusted under 35 U.S.C. 154(b) by 0 days.

(21) Appl. No.: 15/425,036

(22) Filed: Feb. 6, 2017

(65) Prior Publication Data

US 2017/0309260 A1 Oct. 26, 2017

Related U.S. Application Data

(60) Provisional application No. 62/291,945, filed on Feb. 5, 2016.

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | | |
|---|---|---|---|---|---|
| 2,513,930 | A * | 7/1950 | Goldrich | G10D 13/003 | 15/171 |
| 4,453,447 | A * | 6/1984 | Shinneman | G10D 13/003 | 84/282 |
| 6,162,979 | A * | 12/2000 | Gauger | G10D 13/003 | 84/402 |
| 2008/0250912 | A1* | 10/2008 | Van Dorssen | G10D 13/003 | 84/422.4 |
| 2009/0000459 | A1* | 1/2009 | Lento | G10D 13/003 | 84/422.4 |
| 2010/0257992 | A1* | 10/2010 | Watson | G10D 13/003 | 84/422.4 |
| 2015/0330091 | A1* | 11/2015 | Liao | E04F 21/165 | 15/105.5 |

* cited by examiner

*Primary Examiner* — Kimberly Lockett
(74) *Attorney, Agent, or Firm* — Nelson Mullins Riley & Scarborough LLP

(57) ABSTRACT

A bachi for playing a shamisen, comprising a handle portion having a first end and a second end, a blade portion removably disposed on the first end of the handle portion, and an attachment assembly that removably secures the blade portion to the first end of the handle portion.

8 Claims, 9 Drawing Sheets

BACHI FOR A SHAMISEN

CLAIM OF PRIORITY

This application claims priority to U.S. Provisional Patent Application No. 62/291,945, filed Feb. 5, 2016, the entire disclosure of which is incorporated by referenced herein.

FIELD OF THE INVENTION

The present invention relates generally to stringed instruments. More particularly, the present invention relates to a bachi for use in playing a shamisen.

BACKGROUND OF THE INVENTION

As shown in FIG. 1, a shamisen 10 is a three-stringed Japanese musical instrument that is played with a bachi 12. A bachi 12 is similar to a traditional guitar-style pick and that is used to manipulate the strings of the shamisen. Note, however, a traditional bachi 12 is substantially larger than a guitar pick and is held in the entire hand of the user rather than between the thumb and forefinger. As shown, known bachis 12 include a handle 14 and a blade 16 that are unitarily formed, and are symmetric about a longitudinal center axis of the bachi. Known bachis tend to have handles 14 that are square or rectangular in cross-section, meaning they can cause discomfort when used for long periods of time. This is especially true among elderly persons, people with arthritis or similar issues, etc., that may incur discomfort or find it impossible to properly hold a traditional bachi. As well, those that are new to playing a shamisen and are in the learning stages may prefer a bachi that is easier to grasp. Moreover, when learning to play a shamisen 10, it is preferable to have a bachi 12 that includes a slightly flexible blade 16, or whereas more experienced players prefer a bachi with a rigid blade 16. In that known bachis include handles 14 and blades 16 that are unitarily formed, one must have multiple bachis 12 on hand to allow persons with varying levels of experience to play a shamisen 10.

The present invention recognizes and addresses considerations of prior art constructions and methods.

SUMMARY OF THE INVENTION

One embodiment of the present invention provides a bachi for playing a shamisen including a handle portion having a first end and a second end, a blade portion removably disposed on the first end of the handle portion, and an attachment assembly that removably secures the blade portion to the first end of the handle portion.

Another embodiment of the present invention provides a bachi for playing a shamisen including a handle portion having an arched body with a first end and a second end, and a blade portion disposed on the first end of the handle portion.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
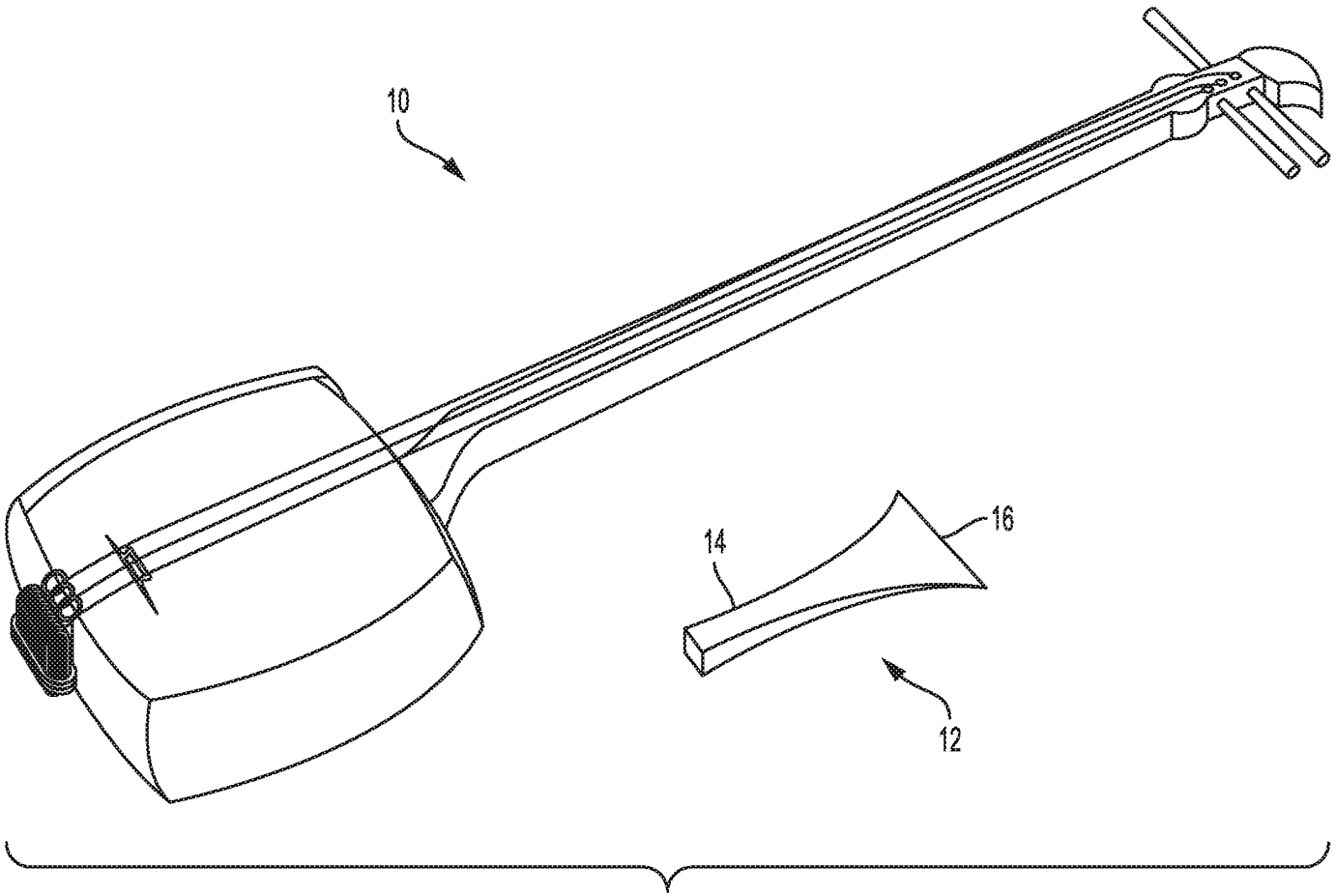
FIG. 1 PRIOR ART
FIG. 1 is a perspective view of a shamisen and prior art bachi.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the figures, an embodiment of a bachi 100 in accordance with the present disclosure is shown. Bachi 100 includes a handle portion 102 and a blade portion 106 that is removably secured to a first end of handle portion 102 with a connector assembly 110. As shown, connection assembly 110 includes a threaded stem 112 disposed on the first end of handle portion 102, threaded stem 112 being rotatably engagable with a corresponding threaded recess 130 formed in the base of blade portion 106, as best seen in FIGS. 2C and 2D. A thumb wheel 114 is non-rotatably fixed to threaded stem 112 so that rotation of thumb wheel 114 causes threaded stem 112 to rotate as well. A recess 108 formed in handle portion 102 allows access to thumb wheel 114 so that blade portions 106 may be attached and released from handle portion 102 as desired.

Figure 2A:
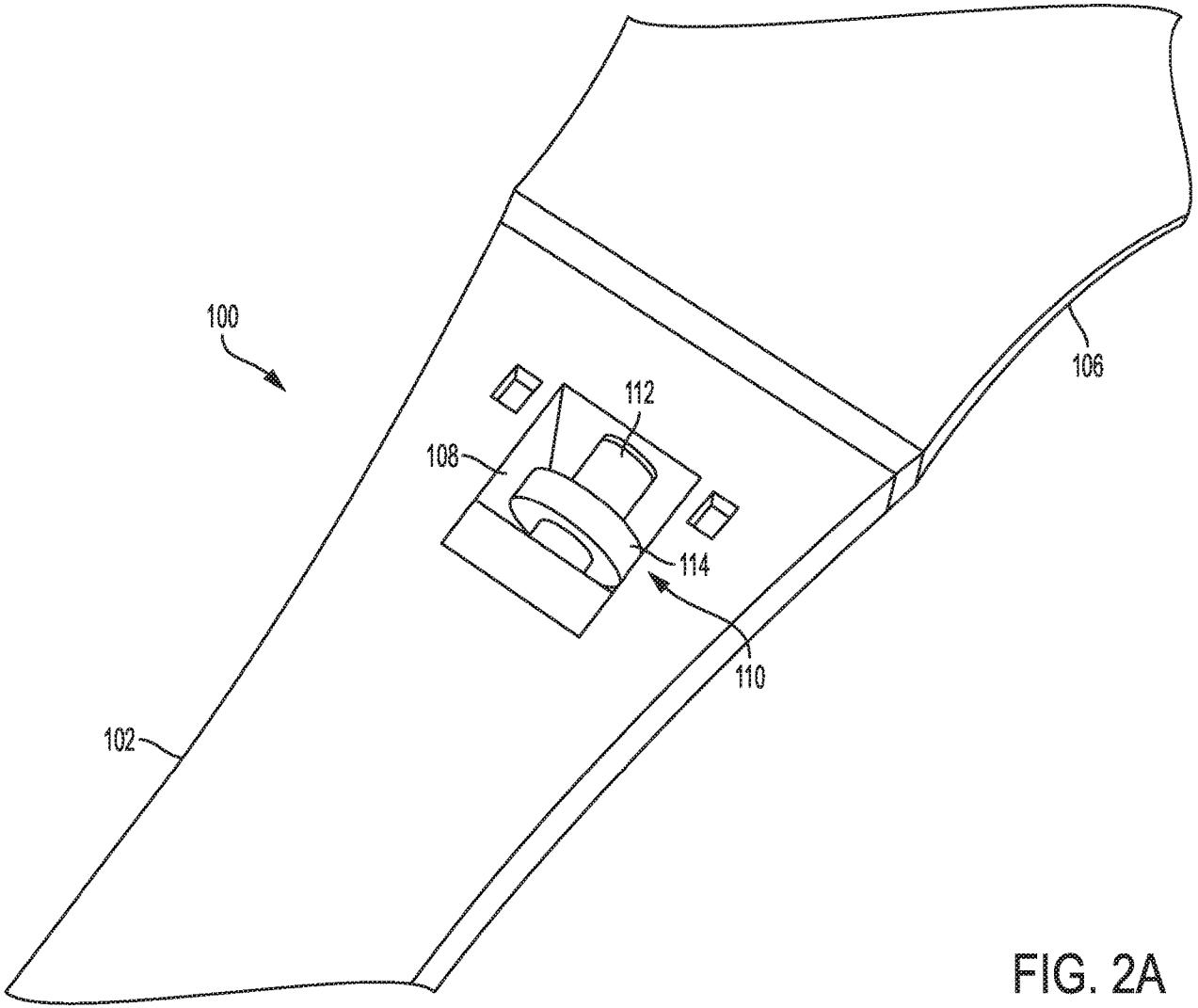
FIGS. 2A through 2E are perspective views of an embodiment of a bachi in accordance with the present disclosure, showing the removal of a blade from the corresponding handle 14.
Figure 2B:
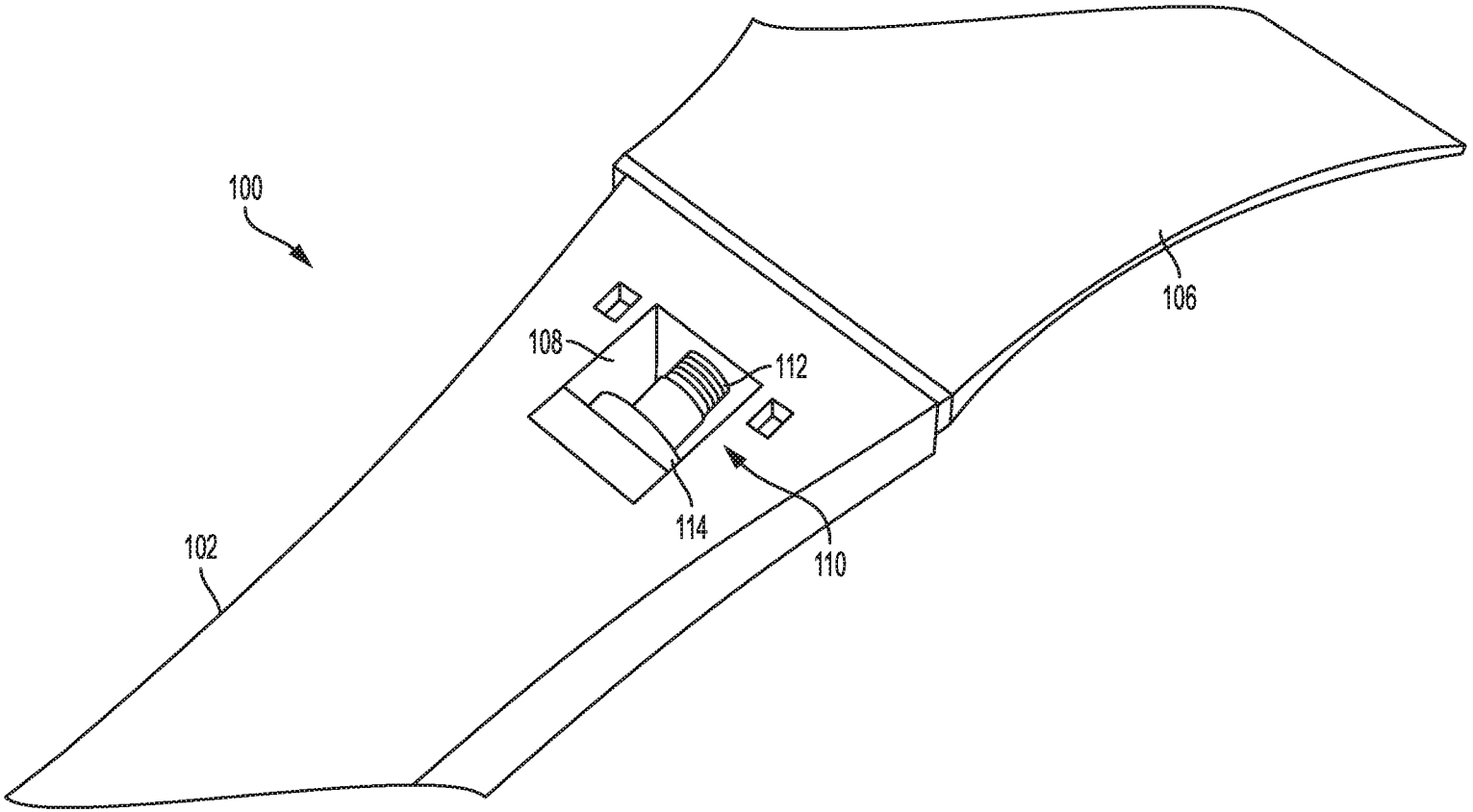
Figure 2C:
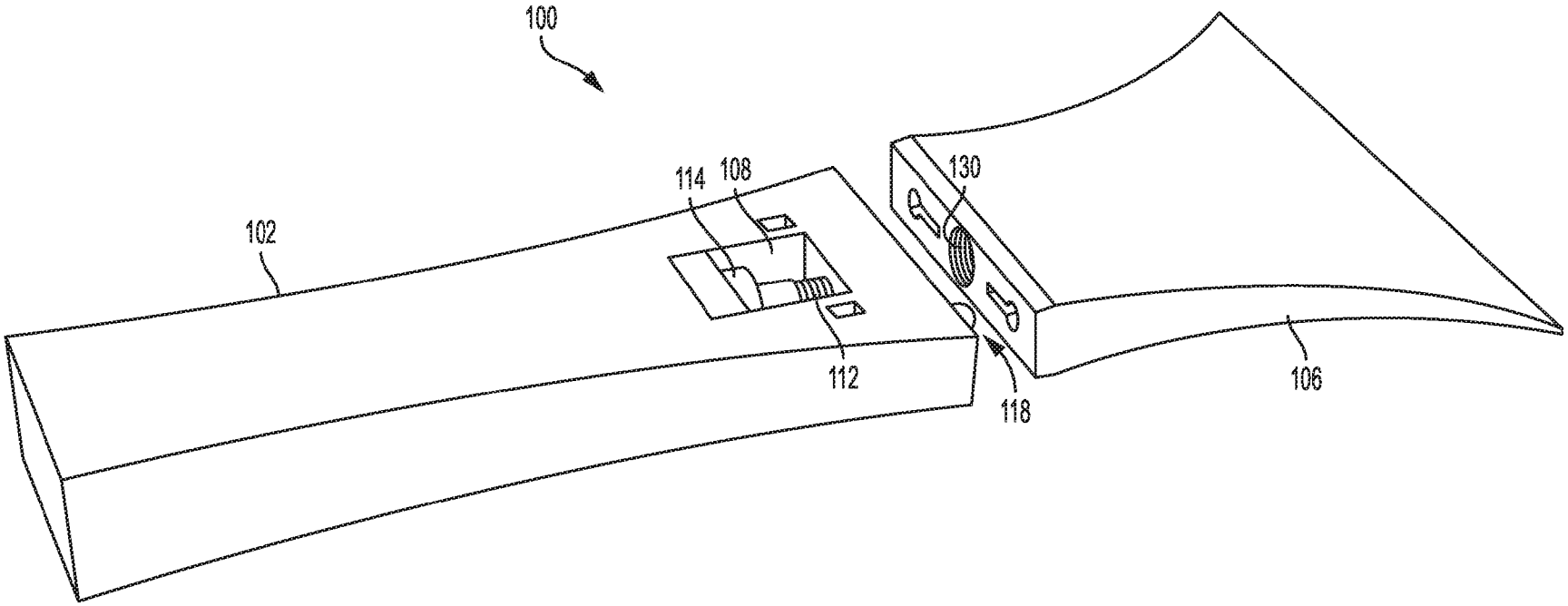
Figure 2D:
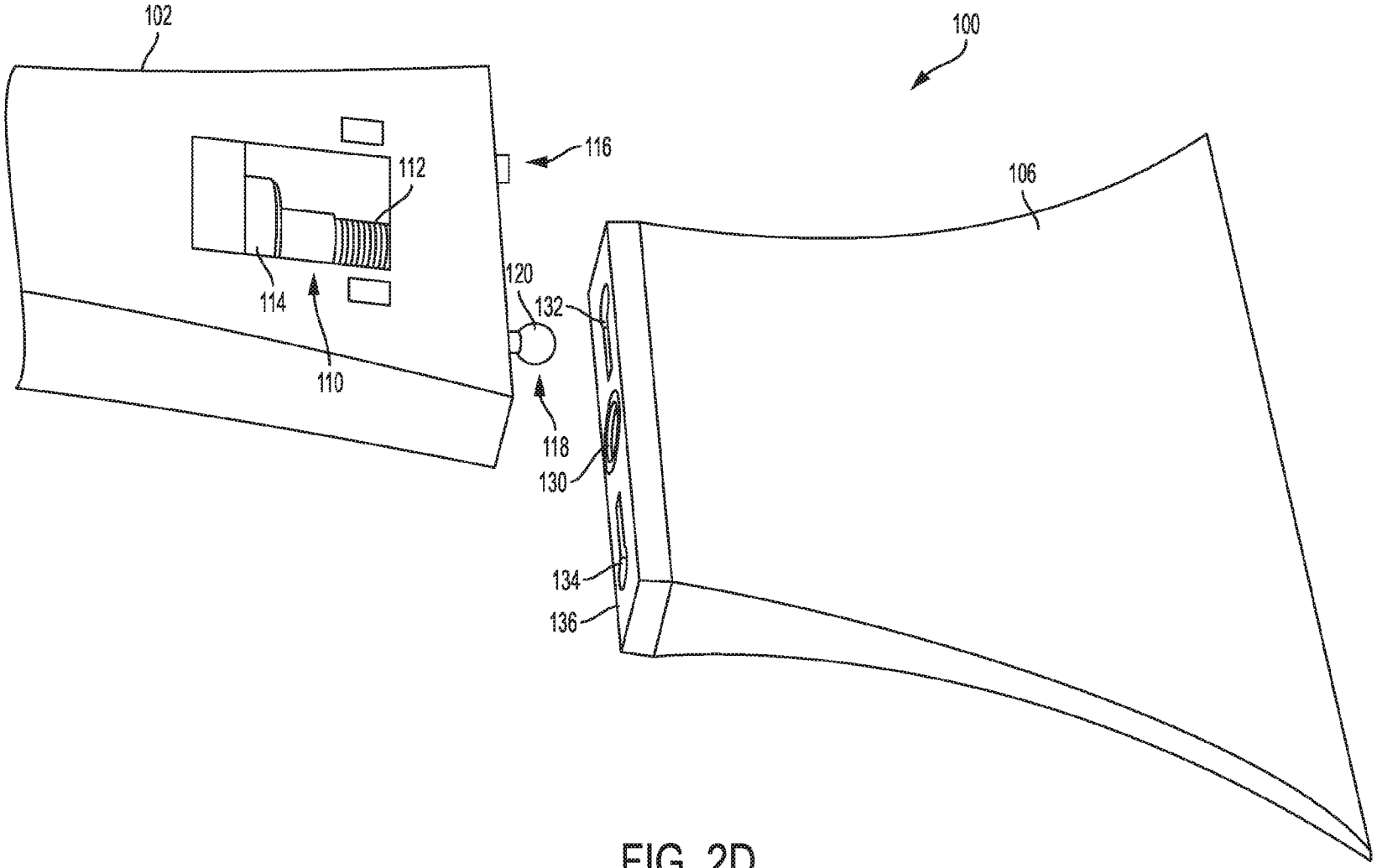
Figure 2E:
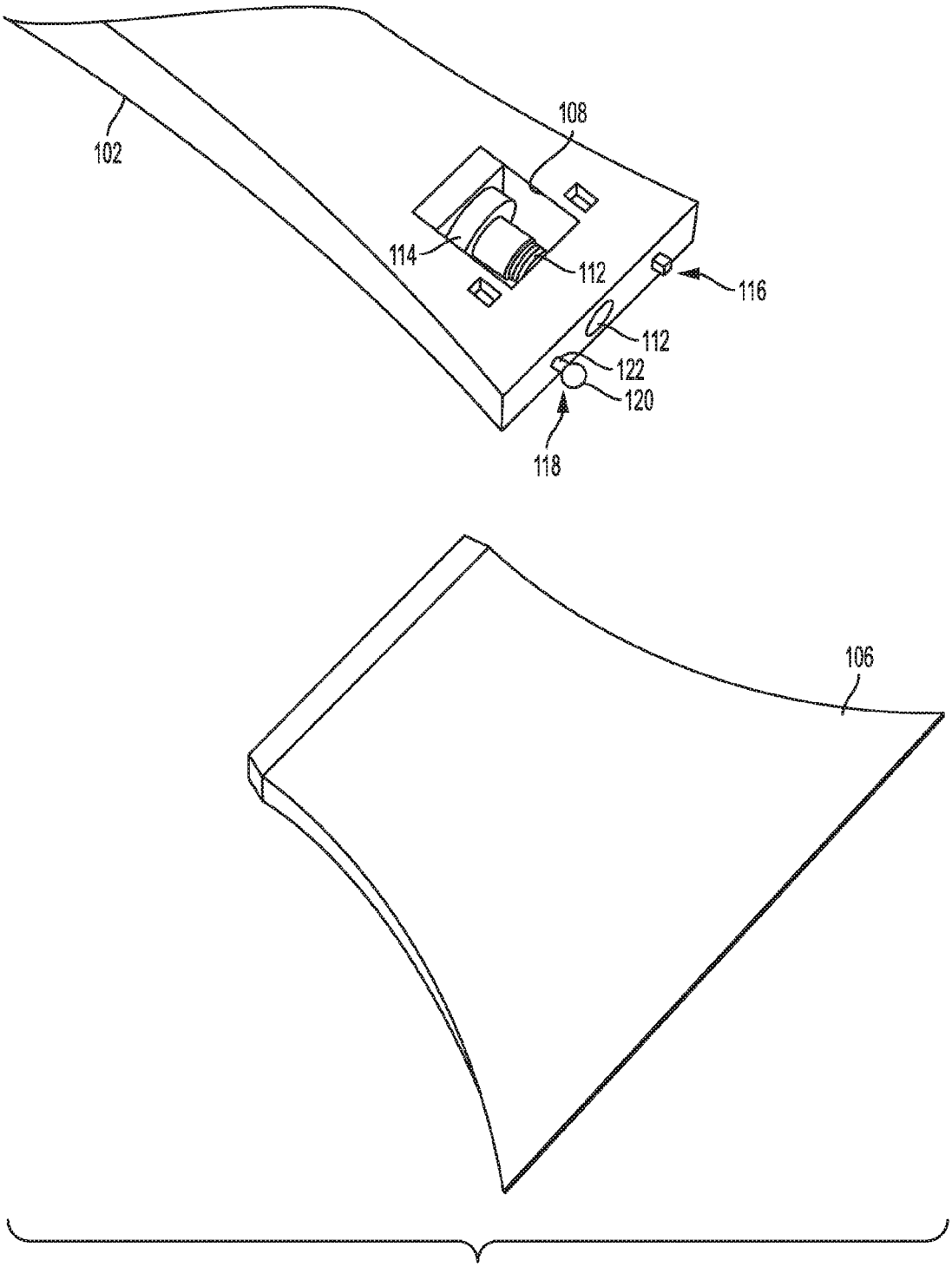

As best seen in FIGS. 2D and 2E, connection assembly 110 also includes a first projection 116 and a second projection 118 that extend axially-outwardly from the first end of handle portion 102. Additionally, a first slot 132 and a second slot 134 are formed in the base portion of blade portion 106 and are configured to slidably receive first projection 116 and second projection 118, respectively. As shown, second projection 118 has a stem 122 and a head portion 120 at its end that has a greater circumference than the stem. Correspondingly, second slot 134 has an enlarged aperture 136 that allows head portion 120 to pass therethrough, whereas the remainder of the slot is more narrow than head portion 120 so that second projection 118 can only be removed from second slot 134 when head portion 120 is aligned with enlarged aperture 136. The engagement of the first and second projections with the first and second slots helps insure blade portion 106 is properly aligned with handle portion 102 prior to engaging threaded recess 130 with threaded stem 112.

Still referring to FIGS. 2A through 2E, securing a blade portion 106 to handle portion 102 is now addressed. As best seen in FIG. 2D, to secure blade portion 106 to handle portion 102, head portion 120 of second projection 118 is axially aligned with enlarged aperture 136 of second slot 134. Once head portion 120 passes through enlarged aperture 136, blade portion 106 is moved downwardly so that the remainder of second slot 134 passes over the stem 122 of second projection 118. The interaction of head portion 120 with slot 134 prevents inadvertent axial movement of blade 106 away from handle portion 102 prior to it being secured thereto. Note also, first projection 116 is now disposed in first slot 132. Referring now to FIG. 2B, engagement of the first and second projections with the first and second slots insures that threaded stem 112 of connector assembly 110 is axially aligned with threaded recess 130 on blade portion 106. Once aligned, thumb wheel 114 is rotated in the clockwise direction. Subsequent rotation of threaded stem 112 in the clockwise direction causes the threaded stem to engage threaded recess 130 as the threaded stem and thumb wheel move axially toward blade portion 106. As best seen in FIG. 2A, thumb wheel 114 moves forward with respect to the handle until threaded stem 112 is fully seated in threaded recess 130. To remove blade portion 106 from handle portion 102, the above described steps are merely performed in a reverse sequence. Because blade portions 106 are interchangeable, handle portion 102 may be used with any number of different blade portions. As such, a blade portion 106 can be matched to the desires of the user (i.e., a rigid blade, a flexible blade, etc.).

Figure 3:
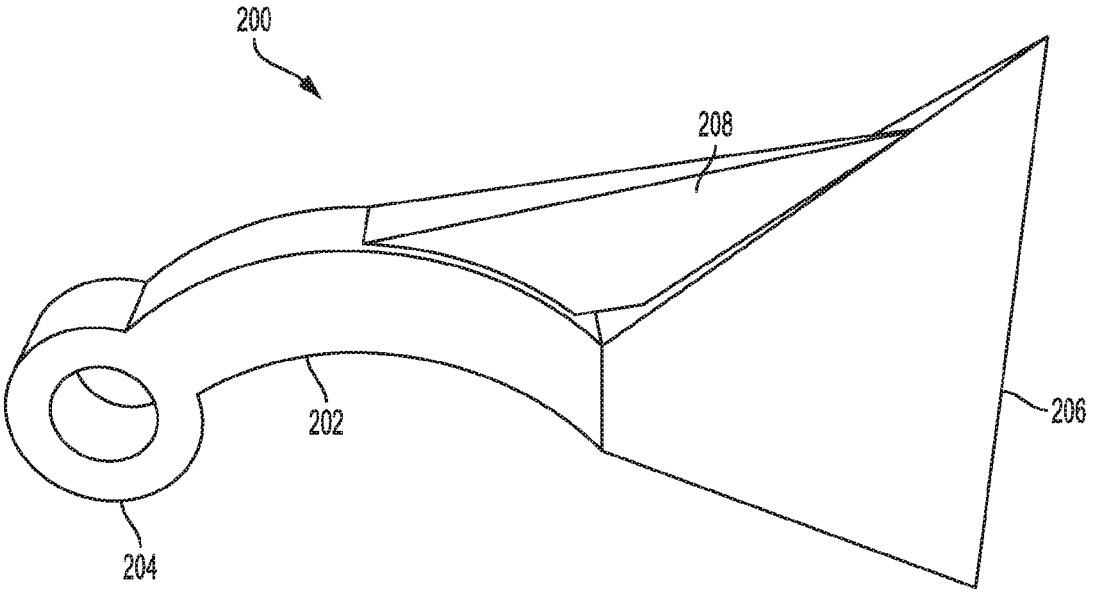
FIG. 3 is a perspective view of an alternate embodiment of a bachi in accordance with the present disclosure.
Figure 4:
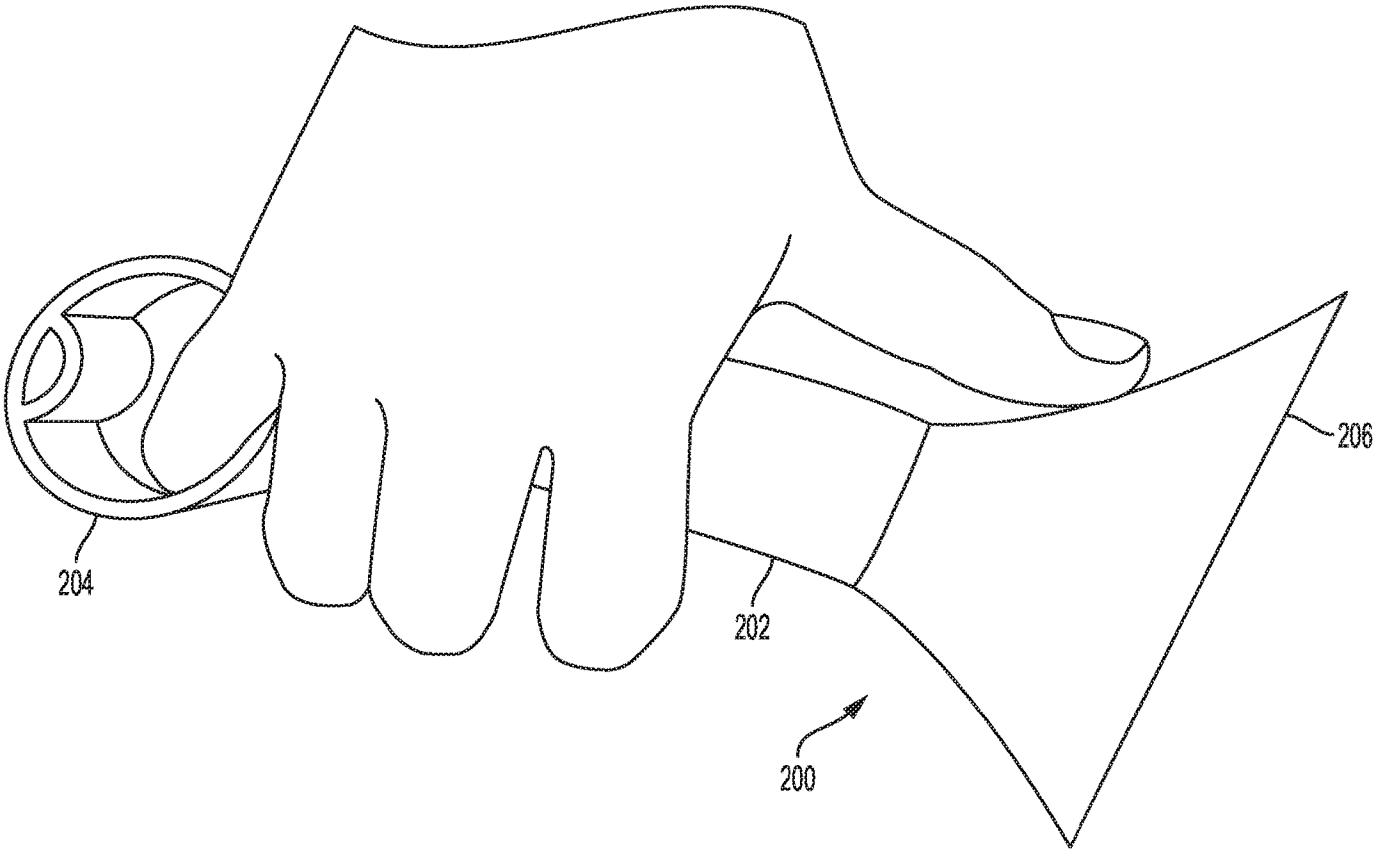
FIG. 4 is a perspective view of the bachi as shown in FIG. 3, being gripped by a user.

Referring now to FIG. 3, an alternate embodiment of a bachi 200 in accordance with the present disclosure is shown. Similarly to the previously discussed embodiment, bachi 200 includes both a handle portion 202 and a blade portion 206. Additionally, bachi 200 includes a ring 204 disposed on the second end of handle portion 202 opposite blade portion 206. Referring additionally to FIG. 4, ring 204 is configured to allow a user's finger to be inserted therein to assist in comfortably holding the bachi. This can be especially advantageous to those users wither arthritis or other similar maladies. Further, handle portion 202 defines an arched body extending from blade portion 206 to ring 204. The arched body of handle portion 202 also facilitates comfortably gripping the bachi, as shown in FIG. 4. This is especially true when a thumb rest 208 is provided on the upper surface of bachi 200 at the base of blade portion 206. Preferably, thumb rest 208 is formed by an insert of a material that is softer than handle portion 202 of the bachi, such as rubber. As well, the handle portion 202 of bachi 200 may be weighted with an insert of a material like lead, bismuth, etc.

Figure 5:
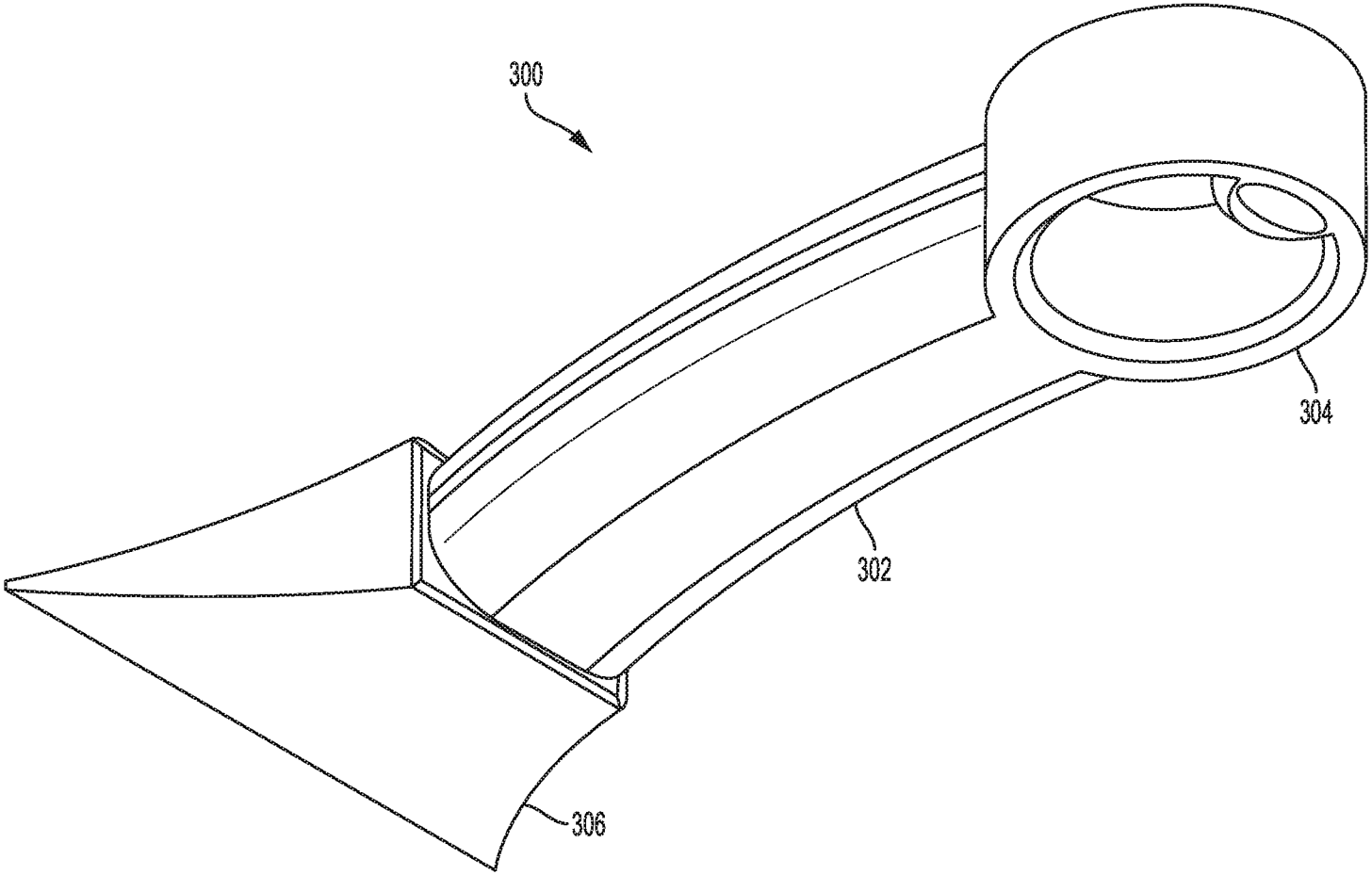
FIG. 5 is a perspective view of an alternate embodiment of a bachi in accordance with the present disclosure.

Referring now to FIG. 5, yet another embodiment of a bachi 300 in accordance with the present disclosure is shown. Similarly to the embodiment shown in FIG. 3, bachi 300 includes an arch-shaped body portion 302, a ring 304 disposed at one end of handle portion 302, and a blade portion disposed opposite ring 304 at the other end of body portion 302. Bachi 300 differs primarily from the previously discussed embodiments in that a cross-sectional shape of handle portion 302 taken transverse to a longitudinal center axis of the bachi is substantially oval-shaped, rather than rectangular or square-shaped. The cross-sectional shape having rounded edges is intended to provide a more comfortable grip for beginning players that is not found in existing bachis.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. A bachi for playing a shamisen, comprising:

a handle portion having a first end and a second end;

a blade portion removably disposed on the first end of the handle portion; and an attachment assembly that removably secures the blade portion to the first end of the handle portion, the attachment assembly including a threaded stem that is rotatably secured to one of the handle portion and the blade portion, a thumb wheel that is non-rotatably affixed to the threaded stem so that rotation of the thumb wheel allows the threaded stem to rotate, and a threaded bore disposed on the other of the handle portion and the blade portion, wherein the threaded stem is selectively engagable with the threaded bore so that the blade portion is securable to the handle portion.

2. The bachi of claim 1, further comprising at least one projection on one of the handle portion and the blade portion, and at least one slot formed in the other of the handle portion and the blade portion, wherein the at least one projection is slidably received in the at least one slot so that the blade portion properly aligns with the handle portion.

3. The bachi of claim 1, wherein the handle portion further includes an arched body that extends from the first end to the second end.

4. The bachi of claim 1, wherein the handle portion further comprises a ring disposed on the second end, the ring defining a bore that is configured to receive a digit of a user's hand.

5. A bachi for playing a shamisen, comprising:

a handle portion having an arched body that extends from a first end and a second end of the handle portion;

a blade portion disposed on the first end of the handle portion;

an attachment assembly that removably secures the blade portion to the first end of the handle portion; and wherein the attachment assembly further comprises a threaded stem that is rotatably secured to one of the handle portion and the blade portion, and a threaded bore disposed on the other of the handle portion and the blade portion, wherein the threaded stem is selectively engagable with the threaded bore so that the blade portion is securable to the handle portion.

6. The bachi of claim 5, wherein the handle portion further comprises a ring disposed on the second end, the ring defining a bore that is configured to receive a digit of a user's hand.

7. The bachi of claim 5, wherein the attachment assembly further comprises a thumb wheel that is non-rotatably affixed to the threaded stem so that rotation of the thumb wheel allows the threaded stem to rotate.

8. The bachi of claim 7, further comprising at least one projection on one of the handle portion and the blade portion, and at least one slot formed in the other of the handle portion and the blade portion, wherein the at least one projection is slidably received in the at least one slot so that the blade portion properly aligns with the handle portion.

* * * * *